US010249270B2

(12) United States Patent
Catalano et al.

(10) Patent No.: US 10,249,270 B2
(45) Date of Patent: Apr. 2, 2019

(54) METHOD AND SYSTEM FOR COMPROMISE TUNING OF MUSICAL INSTRUMENTS

(71) Applicant: International Business Machines Corporation, Armonk, NY (US)

(72) Inventors: Pasquale A. Catalano, Wallkill, NY (US); Andrew G. Crimmins, Montrose, NY (US); Arkadiy O. Tsfasman, Wappingers Falls, NY (US); John S. Werner, Putnam Valley, NY (US)

(73) Assignee: International Business Machines Corporation, Armonk, NY (US)

( * ) Notice: Subject to any disclaimer, the term of this patent is extended or adjusted under 35 U.S.C. 154(b) by 0 days.

(21) Appl. No.: 15/356,266

(22) Filed: Nov. 18, 2016

(65) Prior Publication Data

US 2018/0144726 A1 May 24, 2018

(51) Int. Cl.

| | |
|---|---|
| ***G10D 9/00*** | (2006.01) |
| ***G10G 7/00*** | (2006.01) |
| ***G10D 7/10*** | (2006.01) |
| ***G10G 7/02*** | (2006.01) |

(52) U.S. Cl.
CPC ..... *G10D 9/005* (2013.01); *G10D 7/10* (2013.01); *G10G 7/00* (2013.01); *G10G 7/02* (2013.01)

(58) Field of Classification Search
CPC ..... G10D 9/005; G10D 7/10; G10G 7/00
See application file for complete search history.

(56) References Cited

U.S. PATENT DOCUMENTS

| | | | | | |
|---|---|---|---|---|---|
| 1,171,647 | A * | 2/1916 | Reynolds | G10D 9/005 | 84/386 |
| 1,662,076 | A * | 3/1928 | Newman | G10D 7/10 | 84/394 |
| 2,485,021 | A * | 10/1949 | Strupe | G10D 9/005 | 84/380 R |
| 2,734,417 | A * | 2/1956 | Hindsley | G10D 7/10 | 84/394 |
| 2,738,696 | A * | 3/1956 | Ritterbach | G10D 9/005 | 84/394 |
| 2,802,387 | A * | 8/1957 | Bushnell | G10D 9/005 | 84/386 |

(Continued)

FOREIGN PATENT DOCUMENTS

KR 101392182 B1 5/2014

*Primary Examiner* — Robert W Horn
(74) *Attorney, Agent, or Firm* — Patterson + Sheridan, LLP

(57) ABSTRACT

The disclosure provides an approach for tuning musical instruments. In one embodiment, a tuning application determines frequencies of a series of notes played on a brass instrument, either with open tuning or with a valve pressed. As a musician holds a last note in the series and a tuning or valve slide is moved, the tuning application determines, based on a change in frequency of the last note and the measured frequencies of the other notes in the series, the change in frequency of the other notes. The tuning application then determines a compromise tuning that minimizes the total difference between the current frequencies of the notes and known note frequencies in a frequency table or previously tuned note frequencies if any of the notes were previously tuned. Upon achieving the compromise tuning, the musician or an actuator is instructed to stop moving the tuning or valve slide.

18 Claims, 7 Drawing Sheets

(56) References Cited

U.S. PATENT DOCUMENTS 3,433,114 A * 3/1969 Seme ..... G10D 7/10 84/394
3,861,264 A * 1/1975 Matsumoto ..... G10D 9/005 84/387 R
4,276,804 A * 7/1981 Holland ..... G10D 9/005 84/394
4,512,233 A * 4/1985 Holland ..... G10D 9/005 84/387 R
4,714,001 A * 12/1987 Kergomard ..... G10D 9/005 84/380 R
4,803,908 A 2/1989 Skinn et al.
4,909,126 A 3/1990 Skinn et al.
5,063,818 A * 11/1991 Salazar ..... G10D 3/06 84/314 R
5,249,499 A * 10/1993 Goldstein ..... G10D 9/005 84/386
5,375,499 A * 12/1994 Leonard ..... G10D 7/10 84/395
5,404,783 A * 4/1995 Feiten ..... G10D 3/04 84/298
5,435,222 A * 7/1995 Leonard ..... G10D 7/10 84/388
5,600,079 A * 2/1997 Feiten ..... G10D 3/04 84/298
5,668,340 A 9/1997 Hashizume et al.
5,728,956 A * 3/1998 Feiten ..... G10D 3/04 84/267
5,814,745 A * 9/1998 Feiten ..... G10D 3/14 84/312 R
6,087,572 A * 7/2000 Dillon ..... G10D 9/00 84/387 R
6,433,264 B1 * 8/2002 Gimpel ..... G10D 3/12 84/314 N
7,148,411 B2 * 12/2006 Hsieh ..... G10D 7/066 84/386
7,402,738 B2 * 7/2008 Sawada ..... G10D 7/10 84/380 R
7,655,851 B2 * 2/2010 Nagakura ..... G10G 7/02 84/312 R
7,705,228 B2 * 4/2010 Hilliard ..... G10D 7/10 84/330
7,795,517 B2 * 9/2010 Miller ..... G10D 3/06 84/293
7,851,686 B1 * 12/2010 Davidson ..... G10D 7/026 84/454
8,283,540 B2 * 10/2012 Slater ..... G10D 9/005 84/380 R
8,461,439 B2 * 6/2013 Rashleigh ..... G10D 7/10 84/387 R
8,569,605 B2 10/2013 Grace
8,927,838 B2 1/2015 Jalgha
2005/0076769 A1 * 4/2005 Singer ..... G10D 7/10 84/387 R
2005/0211064 A1 9/2005 Chiba
2008/0105107 A1 5/2008 Adams
2017/0213528 A1 * 7/2017 Meehan ..... G10D 9/005
2018/0144726 A1 * 5/2018 Catalano ..... G10D 9/005

* cited by examiner

METHOD AND SYSTEM FOR COMPROMISE TUNING OF MUSICAL INSTRUMENTS

BACKGROUND

Field of the Invention

Embodiments presented in this disclosure generally relate to the tuning of musical instruments. More specifically, embodiments pertain to techniques for compromise tuning of musical instruments.

Description of the Related Art

Musical instruments are tuned by adjusting the pitch of notes to desired standards. The physics of some instruments make it impossible for all notes on those instruments to be in tune at once. In brass instruments in particular, multiple notes can share a common resonant path such that the lowest and highest notes cannot be in tune at the same time. Traditional automated tuning devices that allow a note frequency to be exactly matched to a known correct frequency (e.g., by displaying an indication to the musician when the correct frequency is attained) cannot be used to tune brass instruments, because the notes that share a common resonant path cannot all be matched to correct frequencies at the same time and matching one of the notes will invariably change frequencies of the other notes to be out of tune. Instead, a musician tuning a brass instrument manually makes a compromise to find a balance in which some notes are slightly sharp while other notes are slightly flat. Such a tuning process can be lengthy and tedious, as the musician typically has to switch back and forth between notes continuously until the compromise is found.

SUMMARY

One embodiment described herein provides a computer-implemented method for tuning a musical instrument. The method includes determining initial frequencies of a plurality of notes played on the musical instrument, where the plurality of notes share a resonant path, and determining changes in frequency of one of the plurality of notes resulting from tuning adjustments made to the musical instrument. The method further includes determining changes in frequencies of other notes in the plurality of notes based on the changes in frequency of the one of the plurality of notes and the initial frequencies of the other notes, and determining changed frequencies of the plurality of notes based on the initial frequency of each of the notes and the determined change in frequency of the same note. In addition, the method includes determining, via one or more processors, a first tuning adjustment of the musical instrument that minimizes a sum of differences between the changed frequency of each note in the plurality of notes and a predefined frequency of the note or a frequency to which the note has previously been tuned, and either indicating to a user to stop or automatically stopping the tuning adjustments from being made to the musical instrument when the first tuning adjustment that minimizes the sum of the differences is achieved.

Additional embodiments include a computer-readable storage medium storing an application, which, when executed on a processor, performs the above recited method as well as a system having a processor and a memory storing an application which, when executed on the processor, performs the above recited method.

BRIEF DESCRIPTION OF THE DRAWINGS

So that the manner in which the above recited embodiments are attained and can be understood in detail, a more particular description of aspects of this disclosure, briefly summarized above, may be had by reference to the appended drawings. It is to be noted, however, that the appended drawings illustrate only typical embodiments and are therefore not to be considered limiting of its scope, for the invention may admit to other equally effective embodiments.

To facilitate understanding, identical reference numerals have been used, where possible, to designate identical elements that are common to the figures. It is contemplated that elements and features of one embodiment may be beneficially incorporated in other embodiments without further recitation.

DETAILED DESCRIPTION

Figure 1:
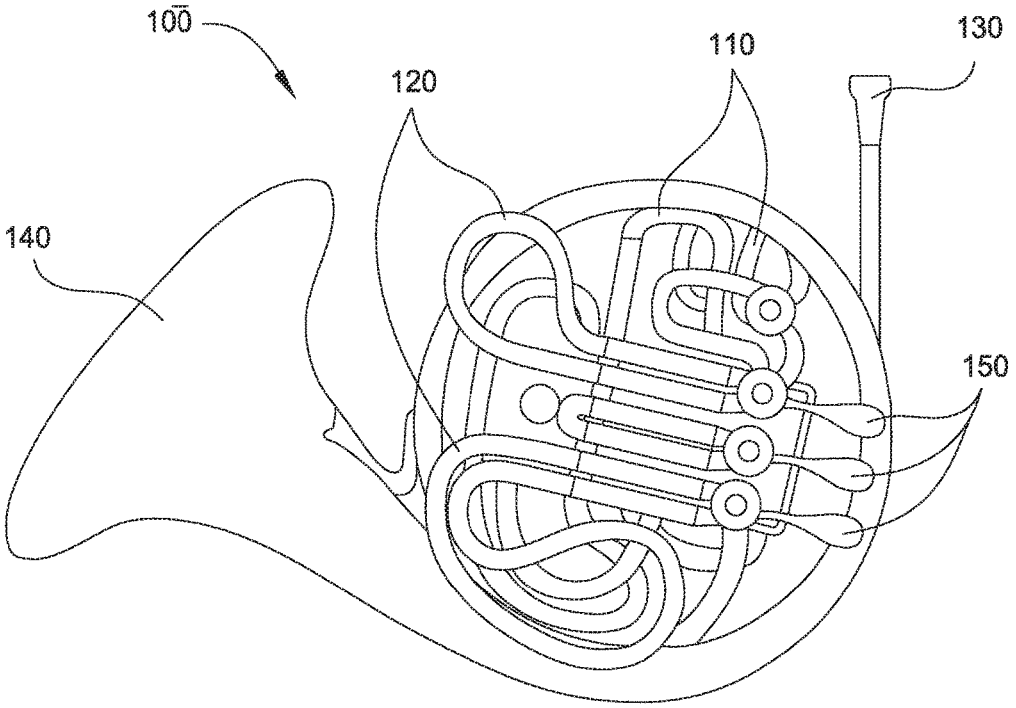
FIG. 1 illustrates an example of a brass instrument, according to an embodiment described herein.

Embodiments disclosed herein provide techniques for automatically tuning musical instruments as well as embodiments that assist a musician during a manual tuning process. Brass instruments are used as a reference example of musical instruments in which all notes cannot be in tune at once, requiring compromises in the tuning process. However, techniques disclosed herein may also be applied to tune other types of instruments, such as guitars, for which compromise tuning is required. In one embodiment, a tuning application determines frequencies of a series of notes played on a horn of a brass instrument, either with open tuning or with a valve pressed. Then, as a musician holds a last note in the series and an appropriate tuning or valve slide is moved, the tuning application determines a change in frequency of the last note, and based on this change in frequency and the measured frequencies of other notes in the series, the tuning application determines changes in frequencies of the other notes. That is, the tuning application samples all the notes in the series and then focuses on the last note and determines, based on the frequency change of the last note and the frequency "checkpoints" created from listening through the entire range of notes, the frequency changes of the other notes in the series. The tuning application then determines an optimal compromise tuning that minimizes the total deviation between the current frequencies of the notes in the series and known note frequencies in a frequency table or previously tuned frequencies, if any of the notes have been tuned before (e.g., on another horn of the instrument). When the optimal compromise tuning is reached, the tuning application indicates to the musician to stop moving the tuning or valve slide. Alternatively, if the tuning or valve slide is being controlled to move automatically via, e.g., an actuator, the tuning application may send a control signal to the actuator to stop moving the tuning or valve slide. In addition, the musician may be asked to play the series of notes again so that the tuning application can check that the notes have been properly tuned. This process may be repeated to tune other tuning or valve slides of the instrument, if any, until all notes of the instrument have been tuned.

In the following, reference is made to embodiments of the invention. However, it should be understood that the invention is not limited to specific described embodiments. Instead, any combination of the following features and elements, whether related to different embodiments or not, is contemplated to implement and practice the invention. Furthermore, although embodiments of the invention may achieve advantages over other possible solutions and/or over the prior art, whether or not a particular advantage is achieved by a given embodiment is not limiting of the invention. Thus, the following aspects, features, embodiments and advantages are merely illustrative and are not considered elements or limitations of the appended claims except where explicitly recited in a claim(s). Likewise, reference to "the invention" shall not be construed as a generalization of any inventive subject matter disclosed herein and shall not be considered to be an element or limitation of the appended claims except where explicitly recited in a claim(s).

The present invention may be a system, a method, and/or a computer program product at any possible technical detail level of integration. The computer program product may include a computer readable storage medium (or media) having computer readable program instructions thereon for causing a processor to carry out aspects of the present invention.

The computer readable storage medium can be a tangible device that can retain and store instructions for use by an instruction execution device. The computer readable storage medium may be, for example, but is not limited to, an electronic storage device, a magnetic storage device, an optical storage device, an electromagnetic storage device, a semiconductor storage device, or any suitable combination of the foregoing. A non-exhaustive list of more specific examples of the computer readable storage medium includes the following: a portable computer diskette, a hard disk, a random access memory (RAM), a read-only memory (ROM), an erasable programmable read-only memory (EPROM or Flash memory), a static random access memory (SRAM), a portable compact disc read-only memory (CD-ROM), a digital versatile disk (DVD), a memory stick, a floppy disk, a mechanically encoded device such as punch-cards or raised structures in a groove having instructions recorded thereon, and any suitable combination of the foregoing. A computer readable storage medium, as used herein, is not to be construed as being transitory signals per se, such as radio waves or other freely propagating electromagnetic waves, electromagnetic waves propagating through a waveguide or other transmission media (e.g., light pulses passing through a fiber-optic cable), or electrical signals transmitted through a wire.

Computer readable program instructions described herein can be downloaded to respective computing/processing devices from a computer readable storage medium or to an external computer or external storage device via a network, for example, the Internet, a local area network, a wide area network and/or a wireless network. The network may comprise copper transmission cables, optical transmission fibers, wireless transmission, routers, firewalls, switches, gateway computers and/or edge servers. A network adapter card or network interface in each computing/processing device receives computer readable program instructions from the network and forwards the computer readable program instructions for storage in a computer readable storage medium within the respective computing/processing device. Computer readable program instructions for carrying out operations of the present invention may be assembler instructions, instruction-set-architecture (ISA) instructions, machine instructions, machine dependent instructions, microcode, firmware instructions, state-setting data, configuration data for integrated circuitry, or either source code or object code written in any combination of one or more programming languages, including an object oriented programming language such as Smalltalk, C++, or the like, and procedural programming languages, such as the "C" programming language or similar programming languages. The computer readable program instructions may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider). In some embodiments, electronic circuitry including, for example, programmable logic circuitry, field-programmable gate arrays (FPGA), or programmable logic arrays (PLA) may execute the computer readable program instructions by utilizing state information of the computer readable program instructions to personalize the electronic circuitry, in order to perform aspects of the present invention.

Aspects of the present invention are described herein with reference to flowchart illustrations and/or block diagrams of methods, apparatus (systems), and computer program products according to embodiments of the invention. It will be understood that each block of the flowchart illustrations and/or block diagrams, and combinations of blocks in the flowchart illustrations and/or block diagrams, can be implemented by computer readable program instructions.

These computer readable program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks. These computer readable program instructions may also be stored in a computer readable storage medium that can direct a computer, a programmable data processing apparatus, and/or other devices to function in a particular manner, such that the computer readable storage medium having instructions stored therein comprises an article of manufacture including instructions which implement aspects of the function/act specified in the flowchart and/or block diagram block or blocks.

The computer readable program instructions may also be loaded onto a computer, other programmable data processing apparatus, or other device to cause a series of operational steps to be performed on the computer, other programmable apparatus or other device to produce a computer implemented process, such that the instructions which execute on the computer, other programmable apparatus, or other device implement the functions/acts specified in the flowchart and/or block diagram block or blocks.

The flowchart and block diagrams in the Figures illustrate the architecture, functionality, and operation of possible implementations of systems, methods, and computer program products according to various embodiments of the present invention. In this regard, each block in the flowchart or block diagrams may represent a module, segment, or portion of instructions, which comprises one or more executable instructions for implementing the specified logical function(s). In some alternative implementations, the functions noted in the blocks may occur out of the order noted in the Figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts or carry out combinations of special purpose hardware and computer instructions.

With reference now to FIG. 1, an exemplary brass instrument is shown. As shown, the brass instrument is a French horn 100. Other types of brass instruments include the trumpet, natural trumpet, trombone, brass trombone, cornet, alto horn, tenor horn, baritone horn, flugel horn, mellophone, euphonium, tuba, bugle, and saxhorn. Illustratively, the French horn 100 is played by blowing into a mouthpiece 130, with most of the energy of the sound wave from the musician's blowing being reflected by a bell 140 back to the mouthpiece 130. The musician can adjust his or her embouchure (shaping of the lips) to produce standing sound waves vibrating at overtone resonances of the horn in order to play notes on the French horn 100.

Brass instruments are tuned by adjusting tuning and/or valve slide(s), such as the tuning sides 110 and valve slides 120 of the French horn 100. Adjusting the tuning slides 110 or the valve slides 120 in or out changes the length of the horn, and the horn may be tuned such that an antinode of the standing sound wave (and its harmonics) produced by the musician blowing into the mouthpiece 130 is created at the bell flair 140 of the instrument 100. Such tuning creates less pressure on the musician's lips when blowing into the mouthpiece 130, making the instrument easier to play, and the instrument also produces a better tone when in tune. Brass instruments often have three valves with respective valve slides, and the valve slides of an instrument may provide finer tuning adjustments than its tuning slides. For example, the main tuning slides 110 of the French horn 100 may be adjusted for coarse tuning correction, while individual valve slides 120 may be adjusted for finer pitch correction. It should be understood that some brass instruments such as the trumpet and the trombone only have a single tuning slide, while other brass instruments such as the French horn have multiple tuning slides. The French horn in particular has a tuning slide for the F-pitch and another slide for the B flat-pitch. In addition, some brass instruments, such as the bugle, do not have valve slides, and such instruments may be tuned by adjusting their tuning slide(s) alone.

Figure 2:
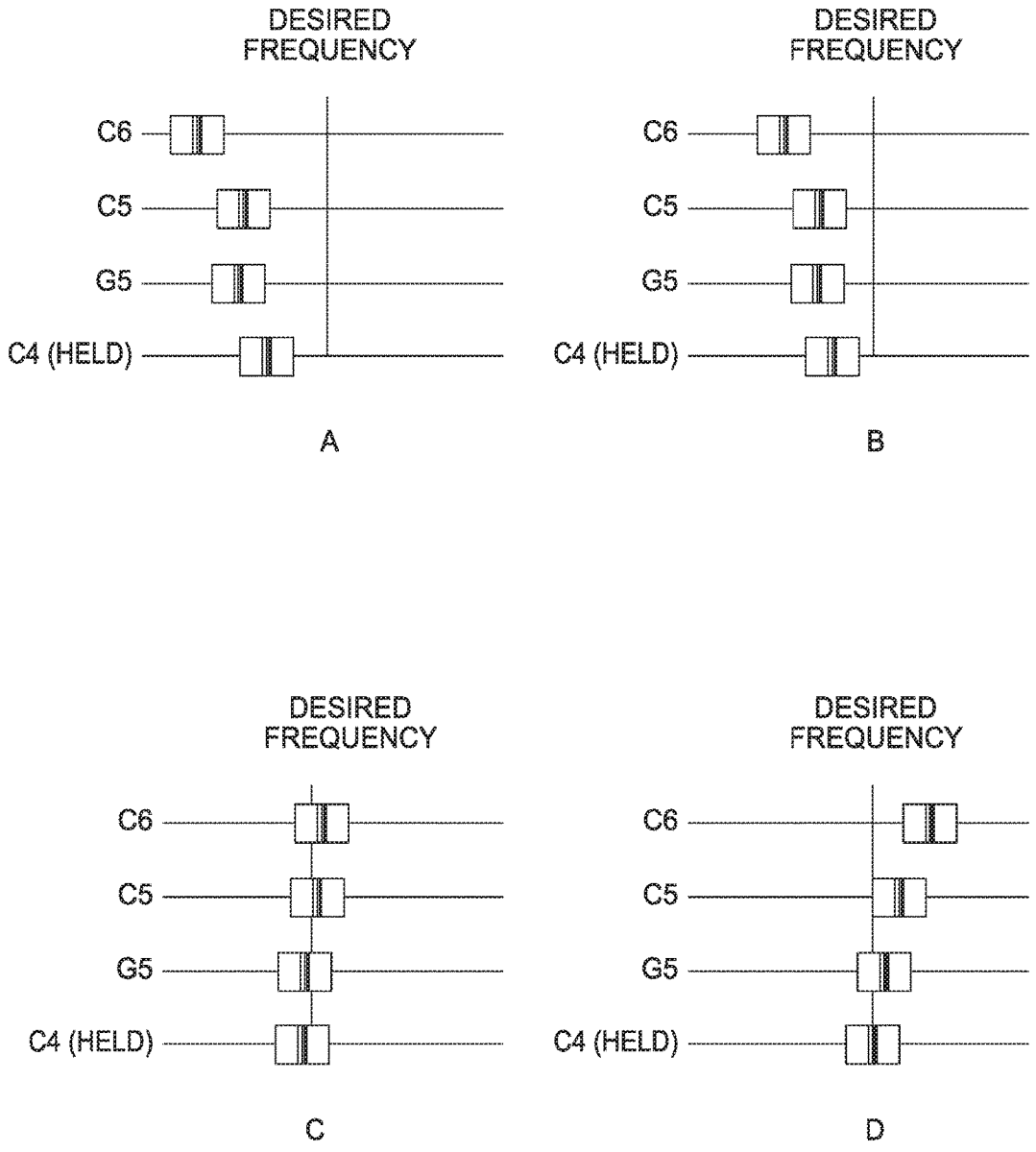
FIG. 2 illustrates an approach for automatically tuning brass instruments, according to an embodiment described herein.

FIG. 2 illustrates an approach for determining the compromise tuning of a brass instrument, according to an embodiment. As shown in panel A, a musician first plays a series of notes that have open tunings on the current horn (and other horns if the instrument has multiple horns), and a tuning application determines frequencies of the notes that have been played. For example, a vibration sensor may be placed on the instrument to measure vibrations at any point that air passes through the instrument, and the tuning application may then process and translate the vibration measurements to note frequencies. Illustratively, the B flat horn of the French horn 100 has been played with open tuning, in which none of the valve levers 150 of the French horn 100 are pressed, and the frequencies of all of the notes played are initially flat relative to the correct note frequencies. The notes on the French horn 100 with open tunings on the B flat horn and the F horn are the octaves of C and G5. The tuning application may indicate (e.g., via a visual indicator such as a light-emitting diode (LED) or a sound command) to the musician to play these notes without pressing on any of the valves. The musician may then play and hold the indicated notes long enough for the note frequencies to be determined, as well as hold the last, lowest note C4 in the series. Although an open tuning of a tuning slide is shown in FIG. 2, it should be understood that a similar technique may be employed to tune valve sides while valves are being pressed by the musician, as discussed in greater detail below.

As shown in panel B, the musician continues to hold the last note during the tuning process, while simultaneously moving one of the tuning slides 110 associated with the horn being played. The tuning application then determines new frequencies of the last note as the tuning slide is moved. It should be understood that French horns can include multiple horns, with newer designs having up to three horns, and one horn may be played at a time when tuning such instruments. Illustratively, the tuning application measures the frequency of the last and lowest note C4 that is being held while the musician moves the tuning slide associated with the B flat horn. The tuning application then determines the change in frequency of the other notes in the series based on the change in frequency of the last note C4. As discussed, multiple notes in a series can share a common resonant path in brass instruments, so changing the frequency of one note during tuning will affect all of the other notes in the series. Generally, moving a tuning (or valve) slide will affect each note in the series differently due to a nonlinear relationship between note frequencies. In one embodiment, the tuning application determines the change in frequency of the last note in cents, the logarithmic unit of measurement for musical intervals, and uses this change in cents of the last note to calculate the change in frequencies of the other notes in the series.

Note frequency and cents are generally related logarithmically, such that moving the tuning slide will change the frequency of a lower note less than it will change the frequency of a higher note, as shown in panel B. In particular, the number of cents is related to note frequencies by:

$$n = 1200 \cdot \log_2\left(\frac{b}{a}\right) \approx 3986 \cdot \log_{10}\left(\frac{b}{a}\right), \tag{1}$$

where a is a first note frequency, b is a second note frequency, and n is a number of cents. Using equation (1), the tuning application may find the number n of cents by plugging in the measured initial and current note frequencies of the last note C4 (i.e., a and b) as the tuning slide is being moved. Equation (1) may also be reformulated to give the relationship between two note frequencies:

$$b=a\times 2^{n/1200}. \quad (2)$$

Using equation (2), the tuning application may determine a new frequency b of one of the other notes in the series by plugging in the initial measured frequency a of that note and the number n of cents determined based on the change of the frequencies of the last note C4. An example of the changed frequencies of the series of notes after the tuning slide is moved is shown in panel B.

As shown in panel C, the tuning application finds a compromise tuning that minimizes the difference between the correct note frequencies in the frequency table, or previously tuned frequencies if any of the notes have been tuned before, and the current note frequencies. The correct note frequencies in the frequency table may be known harmonic frequencies for the notes at which the instrument resonates best. However, previously tuned note frequencies, if any, are used in lieu of such correct frequencies (i.e., the desired note frequency in panel C may be slightly altered to match a previously tuned note rather than the ideal frequency for that note), as some brass instruments have multiple horns and valves and notes played with the instrument's various horns and with valves pressed (and not pressed) should be in tune with each other so that a listener cannot tell the difference when the musician switches between them, i.e., the instrument should to be in tune with itself. Illustratively, such a compromise tuning may be found while the musician holds the last note C4 and moves the tuning slide, and the tuning application may then indicate (e.g., via an LED or a sound command) that open tuning of the current horn is done. Illustratively, the C4 and G5 notes are slightly flat in the final compromise tuning, while the C5 and C6 notes are slightly sharp. Such a comprise is intentionally made to leave the C4 note slightly flat, while the musician holds C4 and moves the tuning slide, so that a greater number of notes across the series are in tune.

It should be understood that, in the compromise tuning, each of the notes in the series may end up being slightly sharp or flat, as it is impossible for all notes in the series to be in tune at once. Attempting to place one of the notes perfectly in tune will, as shown in panel D, cause the other notes to be sharp or flat. Illustratively, the tuning slide has been adjusted such that the C4 note is perfectly tuned to the correct note frequency. However, as a result, the other notes are very sharp. Further, this tuning is not optimal, as the total difference between the in-tune C4 note and the other sharp notes and their correct note frequencies is greater than the total difference of the series of notes in panel C from the correct note frequencies. That is, the optimal compromise tuning in panel C permits all notes in the series of notes to be as close to being in tune as possible across the greatest range of notes, even if some notes are slightly flat or sharp. This is generally preferable to the tuning in panel D in which the C4 note is perfectly in tune but the other notes are very sharp.

Although FIG. 2 shows an example of open tuning of the B flat horn of a French horn, it should be understood that similar techniques may be used to tune other horns as well as to tune valve slides with valves of the instrument pressed and to other brass instruments, as discussed in greater detail below.

Figure 3:
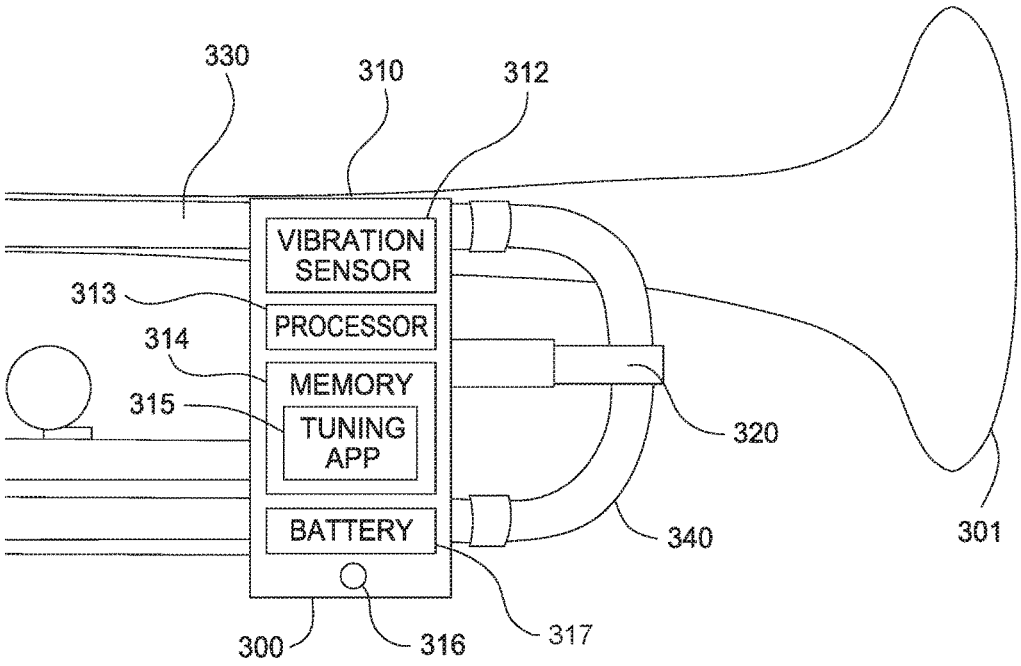
FIG. 3 illustrates a tuning apparatus for adjusting a tuning slide, according to an embodiment described herein.

FIG. 3 illustrates an example of a tuning apparatus 300 for adjusting a tuning slide, according to an embodiment. Although the tuning apparatus 300 is shown as being used on a trumpet, it should be understood that the tuning apparatus 300 or similar tuning apparatuses may be adjusted for use on other types of brass instruments, without hindering their timbre or affecting their tone quality. As shown, the tuning apparatus 300 includes a body 310 and a linear actuator 320. Illustratively, the body 310 is an adjustable bar that can be clamped onto a lead pipe 330 close to the tuning slide 340. The linear actuator 320 is connected to the body 310 of the tuning apparatus 300 and includes a clamp that can be used to grasp the tuning slide 340. Although shown as forming a T-shape, it should be understood that the body 310 and the actuator 320 may have other shapes in alternative embodiments. For example, the body 310 and the actuator 320 may instead form an L shape.

The linear actuator 320 is configured to adjust the tuning slide 340 in response to a control signal from a processor 313 in the body 310 of the tuning apparatus 300. In one embodiment, the linear actuator 320 may be capable of making fine adjustments that would be difficult to make manually.

The body 310 of the tuning apparatus 300 includes the processor 313, a vibration sensor 312, a memory 314 (which includes a tuning application 315), a battery 317, and an indicator 316 which may, e.g., an LED that shows tuning status (e.g., in tune, not tuned, and etc.). The vibration sensor 312 may be used to measure vibrations at any point that air passes through on the instrument independent of the note being played, such as at the lead pipe 330 close to the tuning slide 340. Measuring vibrations is useful for tuning instruments, as such tuning can be performed in a noisy environment.

The Processor 313 processes vibration measurement data obtained with the vibration sensor 312 and translates such data to note frequencies through known methods. In one embodiment, the processor 313 is configured to execute a tuning application 315 stored in the memory 314 to tune the instrument 301. In operation, the tuning application 315 determines the frequencies of a series of notes being played by a musician (e.g., in response to an indication displayed via the indicator 316 or some other means); determines the change in frequency of a last note in the series as the musician holds the last note and moves the tuning slide 340; determines the change in frequency of other notes in the series based on the change in frequency of the last note and the initial frequencies of the other notes; determines whether the tuning slide is in an optimal compromise position that minimizes a difference between the current frequencies of the notes in the series and desired note frequencies, which may include the known frequencies in a frequency table and/or previously tuned note frequencies; and, when the tuning slide is in the optimal compromise position, stops the actuator 320 from moving the tuning slide and indicates to the musician to switch to a next horn to be tuned, as discussed in greater detail below. Although shown being included in the body 310 of the tuning apparatus 300, it should be understood that the processor 313 running the tuning application may also be located elsewhere in other embodiments. For example, the processor that runs the tuning application may be off-board and may push control signals needed to adjust the tuning slide 340 to the tuning apparatus 300. Further, it should be understood that the actuator 320 is optional and, in an alternative embodiment, the musician may manually adjust the tuning slide in response to the processor 313 running the tuning application and indicating via the indicator 316 where the musician should move the tuning slide 340.

Although shown with respect to a single tuning apparatus 300 and tuning slide 340 in FIG. 3, it should be understood that a brass instrument may generally have multiple tuning and valve slides and, in the case of such an instrument, multiple tuning apparatuses may be attached to the instrument at the appropriate places to adjust the multiple tuning and valve slides. In addition, the multiple tuning apparatuses may operate in concert and communicate wirelessly to achieve a compromise tuning in which any note that can be played on different horns or by pressing valves is tuned to the same frequency so that the instrument is in tune with itself.

Figure 4:
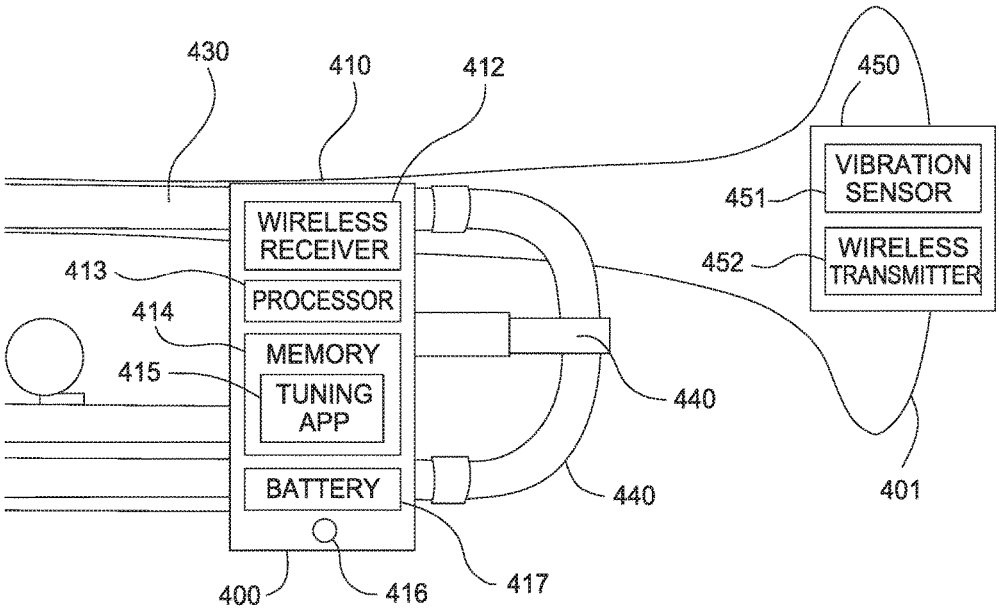
FIG. 4 illustrates a tuning apparatus for adjusting a tuning slide, according to an alternative embodiment described herein.

FIG. 4 illustrates an alternative embodiment in which a vibration sensor 451 is placed in a device 450 that is separate from a tuning apparatus 400, and the tuning apparatus 400 and the separate device 450 communicate wirelessly. As shown, the separate device 450 is attached to the bell of the instrument 401, but the separate device 450 may generally be attached anywhere that air passes through independent of the note being played. The separate device 450 includes a vibration sensor 451 (as well as a processor that determines frequencies from the vibrations) and a wireless transmitter 452 that transmits vibration data to the tuning apparatus 400. The tuning apparatus 400 itself includes a processor 413, a memory 414 with a tuning application 415, and a battery 417, which are similar to the processor 313, memory 314, tuning application 315, and battery 317 of the tuning apparatus 300 discussed above and will not be described in detail for purposes of brevity. In addition, the tuning apparatus 400 includes a wireless receiver 412 for receiving vibration data from wireless transmitter 452. Any feasible wireless protocol may be used, such as near field communication (NFC), radio-frequency identification (RFID), Bluetooth, Wi-Fi, and the like. With NFC and RFID in particular, the separate vibration sensor device would not require its own power source, and NFC also permits two-way communication.

In yet other embodiments, the frequency of notes being played may be determined in other ways, such as using a microphone on the tuning apparatus 300 or 400 or the separate device 450 to capture the note being played and analyzing the captured waveform to determine the frequency of the note, using microphones placed throughout the room and communicating wirelessly with the tuning apparatus 300 or 400 so that instrument can be tuned to sound best in a majority of the room, using an optical sensor and receiver such as those used in strobe tuners, or the like.

Figure 5:
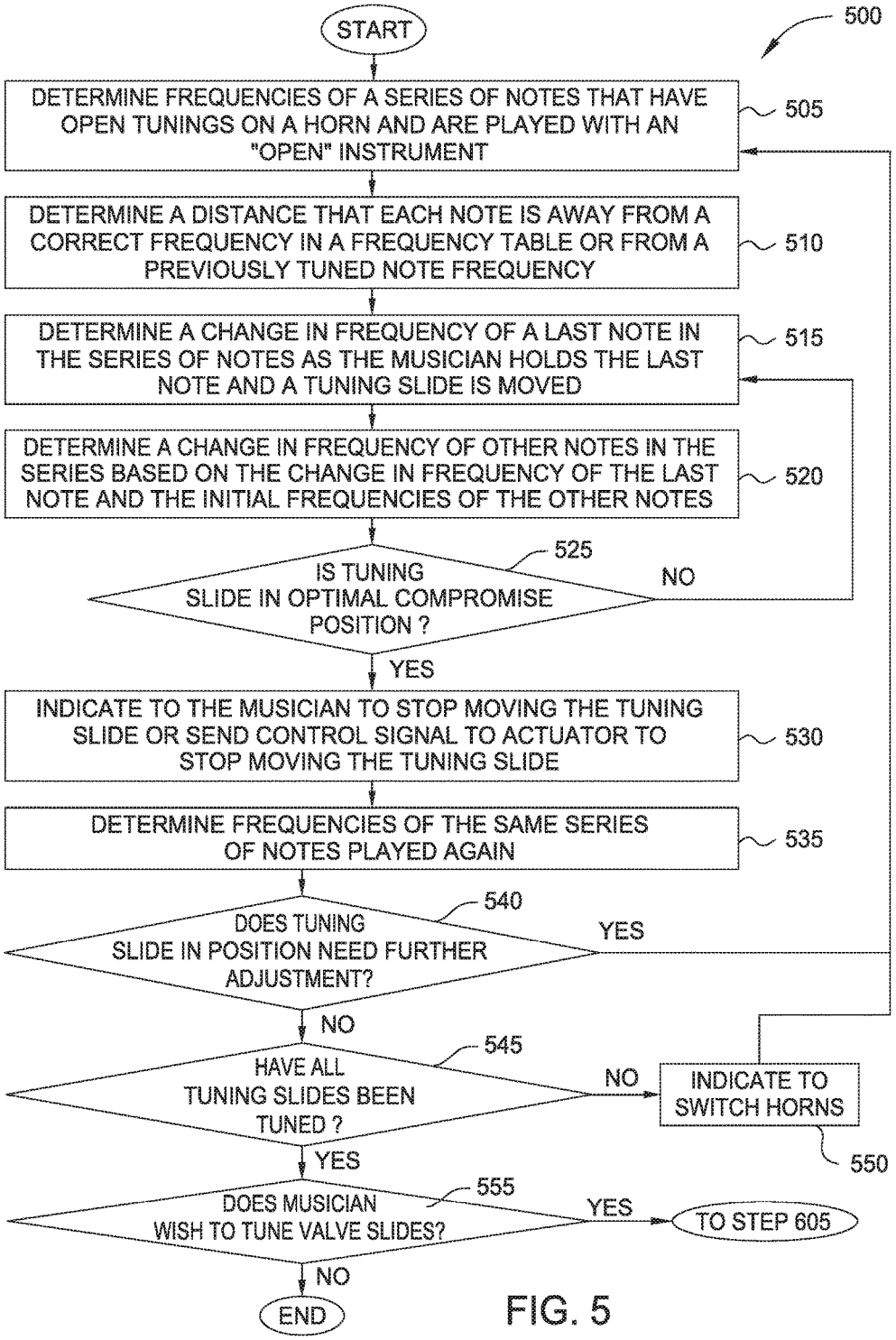
FIG. 5 illustrates a method for tuning tuning slides of a brass instrument, according to an embodiment described herein.

FIG. 5 illustrates a method 500 for tuning tuning slides of a brass instrument, according to an embodiment. As shown, the method 500 begins at step 505, where a tuning application determines the frequencies of a series of notes that have open tunings on a horn of the brass instrument (and on other horns, if any) and that are played by a musician in succession with an "open" instrument (i.e., no valves are pressed). As the musician plays the horn on the open instrument, the tuning application receives (e.g., from a vibration sensor or another type of sensor) and processes data to determine frequencies of the notes that have been played. In one embodiment, the tuning application may indicate (e.g., via an LED or sound commands) the notes the musician should play and how long to hold those notes, with the notes being held long enough so that the tuning application can determine their frequencies. For example, on the French horn, the musician may be instructed to start with the B flat horn, for which all the octaves of C and G5 have open tunings, and to cover the largest range of notes possible for most accurate results.

At step 510, the tuning application determines a distance that each note is away from a correct frequency in a frequency table or from a previously tuned note frequency. As discussed, the frequency table stores correct note frequencies which may be known harmonic frequencies at which the instrument resonates best. However, if any note on the instrument has previously been tuned to a particular frequency, the previously tuned note frequency may be used in lieu of the correct frequency in the frequency table so that the note is always tuned to the same frequency on the instrument.

At step 515, the tuning application determines the change in frequency of a last note in the series of notes as the musician holds the last note and a tuning slide is moved. The last note may be the lowest note in one embodiment. For example, on the French horn, the last note may be C4 for both the F and B flat horns, and this note may be held while the tuning slide is moved. In one embodiment, the tuning application may indicate (e.g., via an LED or sound commands) to the musician to continue holding the last note and to manually move the tuning slide. In an alternative embodiment, the tuning application may send a control signal to an actuator, such as the actuator 320 or 420, to automatically move the tuning slide. The tuning application may then receive and process data, similar to the step 505 discussed above, to determine the frequency of the last note as the tuning slide is being moved. The change in frequency of the last note is then the difference between this determined frequency as the tuning slide is being moved and the initial frequency of the last note.

At step 520, the tuning application determines the change in frequency of other notes in the series of notes based on the change in frequency of the last note determined at step 515 and the initial frequencies of the other notes. As discussed, note frequency and cents are related logarithmically according to equation (1) above, and, using equation (1), the tuning application may find the number of cents that the initial and current note frequencies of the last note differ by as the tuning slide is being moved. In addition, by plugging in the determined number of cents and the initial frequency of another note in the series as measured at step 505 into equation (2), the tuning application may determine the new frequency of the other note. As a result, the tuning application is able to determine the change in frequency of all of the other notes in the series based on the change in frequency of the last note.

At step 525, the tuning application determines whether the tuning slide is in an optimal compromise position. The optimal compromise position is a position in which the total (i.e., the sum) difference between the current and the desired frequencies of the notes in the note series is minimized, i.e., the notes in the series are best in tune as a group. Such a compromise is made so that all notes in the series are as close to being in tune as possible, even if some notes are slightly flat or sharp, which is preferable to having one note perfectly in tune while other notes are very flat or sharp. As discussed, notes on the instrument that can be played in different ways may be tuned to the same frequency, so the desired frequencies of the notes used in determining the optimal compromise position are the previously tuned frequencies of the notes, if any, and the correct note frequencies from a frequency table for notes that have not been previously tuned. The difference between such desired note frequencies and the initial note frequencies was determined at step 510, and the change in frequency of the notes determined at step 515 and 520 may be used to update this difference to determine the current difference between the note frequencies and the desired frequencies. For example, assume the C6, C5, G5, and C4 notes of the B flat horn shown in FIG. 2 differ from their desired note frequencies by $\Delta f_{1,1}$, $\Delta f_{1,2}$, $\Delta f_{1,3}$, and $\Delta f_{1,4}$, respectively. Then, the sum of the differences is:

$$\Delta f_1 = \Delta f_{1,1} + \Delta f_{1,2} + \Delta f_{1,3} + \Delta f_{1,4} \quad (3)$$

The optimal compromise position that the slide should be placed in may then be calculated by minimizing $\Delta f_1$. For example, the tuning application may determine that, by moving all of the notes by a certain number of cents, $\Delta f_1$ is at its minimum, and moving away increases $\Delta f_1$ again.

If the tuning application determines at step 525 that the tuning slide is not in the optimal compromise position, then the method 500 returns to step 515, where the tuning application continues determining the change in frequency of the last note as the tuning slide is moved. Continuing the example from above of tuning the B flat horn, the tuning application may determine that the tuning slide is in the compromise position when the note frequency has changed by the certain number of cents determined to minimize $\Delta f_1$.

On the other hand, if the tuning application determines at step 525 that the tuning slide is in the optimal compromise position, then the method 500 continues to step 530, where the tuning application indicates to the musician to stop moving the tuning slide or, alternatively, sends a control signal to the actuator to stop moving the tuning slide. In addition, the tuning application may calculate the frequencies of all other notes in the series as the tuning slide is moved in case the last note is not stopped in the exact position calculated. For example, the musician may move the tuning slide to a position that correlates to a change in the last note of 101 cents due to human error/actuator accuracy when the optimal compromise position requires a change of 104 cents. The tuning application may then determine the frequencies of the notes in the series based on the change of 101 cents.

At step 535, the tuning application determines the frequencies of the same series of notes as the musician plays them again, similar to the step 505 discussed above. Continuing the example from above, when the series of notes in the B flat horn is played again, assume the frequency of the C6 note is measured at 1080 Hz, whereas C6 moving by 101 cents should correlate to, e.g., 1060 Hz (and other notes in the series may show minor differences as well). This error could be due to imperfections in the instrument during the manufacturing of the instrument, small dents, etc., and can be accounted for in another iteration of the method 500.

At step 540, the tuning application determines whether the tuning slide position needs further adjustment. As discussed, further adjustment may be required, e.g., to account for imperfections in the instrument. If the tuning application determines at step 540 that the tuning slide position needs further adjustment, then the method 500 returns to step 505, where the tuning application determines the frequencies of the series of notes as those notes are played again by the musician with an open instrument. That is, the tuning application again determines a summation of the differences of each note of the series from their desired frequencies, e.g., $\Delta f_2 = \Delta f_{2,1} + \Delta f_{2,2} + \Delta f_{2,3} + \Delta f_{2,4}$, and each iteration will reduce the sum of the differences from the desired frequencies. In one embodiment, the tuning application may compute a delta of the frequency difference (e.g., $\Delta F = \Delta f_1 - \Delta f_2$) and use this delta to determine how much improvement has been made between iterations. In such a case, the tuning application may determine that the tuning slide position needs further adjustment at step 540 if the delta $\Delta F$ is greater than a threshold value and that the tuning slide position does not need further adjustment if the delta $\Delta F$ is less than the threshold (i.e., that less progress is made than the threshold). In addition, if the threshold is never reached, the tuning application may select an optimal position from the previous iterations that have been performed after, e.g., a predefined maximum number of iterations. In an alternative embodiment, the tuning application may simply perform a predetermined number of tuning iterations, and the tuning application may determine whether the tuning slide position needs further adjustment at step 540 based on whether the predefined number of iterations have been performed. For example, experience has shown that three iterations is sufficiently accurate in a majority of cases.

If the tuning application determines at step 540 that the tuning slide position does not need further adjustment, then the method 500 continues to step 545, where the tuning application determines whether all tuning slides have been tuned. If not all of the tuning slides have been tuned, then the tuning application indicates to the musician (e.g., via an LED or sound command) to switch to a next horn at step 550, and the method 500 then returns to step 505, where the tuning application determines the frequencies of a series of notes that have open tunings on the next horn and are played by a musician in succession with an open instrument. For example, on the French horn, the musician may switch to the F horn after the B flat horn has been tuned. If, however, all of the tuning slides have been tuned, then the method 500 continues to step 555, where the tuning application determines if the musician wished to tune any valve slides, and if so, the method 500 proceeds to step 605 of a method 600 for tuning valve slides.

Figure 6:
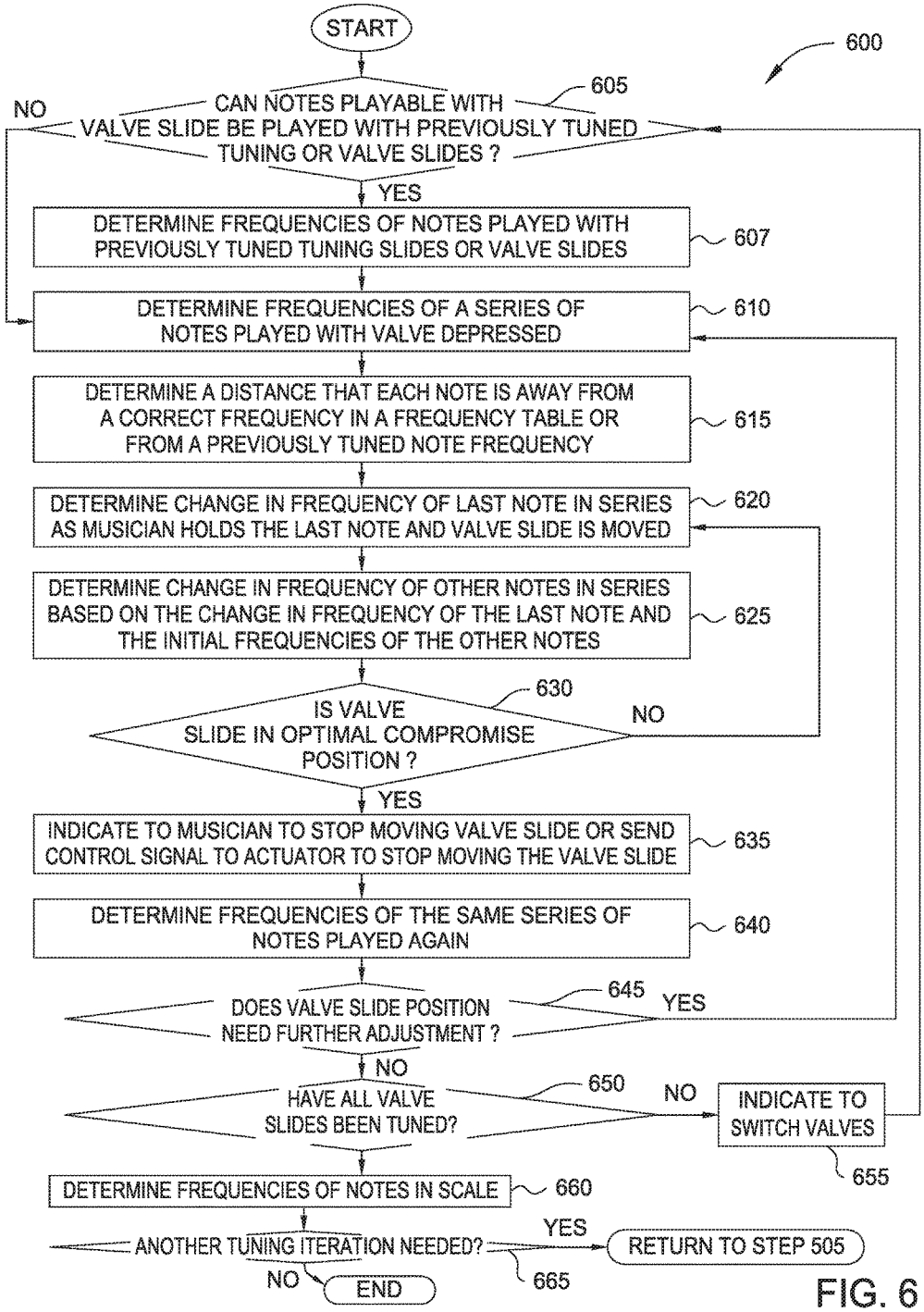
FIG. 6 illustrates a method for tuning valve slides of a brass instrument, according to an embodiment described herein.

FIG. 6 illustrates the method 600 for tuning valve slides in a brass instrument, according to an embodiment. The steps of the method 600 are similar to those of the method 500 discussed above, except that rather than open tuning of tuning slides, valve sides are tuned while valves of the instrument are being pressed by the musician. As shown, the method 600 begins at step 605, where the tuning application determines whether any notes that can be played with the current valve slide can also be played with previously tuned tuning slides or valve slides. If any of the notes can be played with previously tuned tuning slides or valve slides, then, at step 607, the tuning application determines the frequencies of those notes as the musician plays them (e.g., in response to an indication to do so) using the already tuned tuning or valve slides. As discussed, this is done so that the notes played with an instrument's various horns and with valves pressed (and not pressed) can all be in tune with each other so that a listener cannot tell the difference when the musician switches between them.

At step 610, the tuning application determines the frequencies of a series of notes on the brass instrument that are played by the musician in succession, with a valve of the instrument depressed. At step 615, the tuning application determines a distance that each note is away from a correct frequency in a frequency table or from the frequency of the previously tuned note determined at step 607 for any notes that can be played with previously tuned tuning slides or valve slides.

At step 620, the tuning application determines the change in frequency of a last note in the series of notes as the musician holds the last note and a valve slide is moved, either manually by the musician or automatically by an actuator. Then, at step 625, the tuning application determines the change in frequencies of other notes in the series of notes based on the change in frequency of the last note determined at step 620 and the initial frequencies of the other notes determined at step 610. Similar to the step 520 discussed above, the change in frequencies of the other notes may be determined using equations (1) and (2).

At step 630, the tuning application determines, similar to step 525, whether the valve slide is in an optimal compromise position that minimizes a total difference between the current and the desired frequencies of the notes in the note series, which may be the correct frequencies in the frequency table and/or the frequencies that the notes have previously been tuned to. For example, for the first valve on the French horn, notes may be played with open tuning on both the F and B flat horns, i.e., any octave of F on the B flat horn may be played with open tuning, and then the tuned note frequencies may be compared with the same octave of F on the F horn played with the first valve depressed. Similarly for the second valve of the French horn, notes may first be played with open tuning on the F and B flat horns and/or the first valve, and so forth for all other valves.

If the tuning application determines at step 630 that the valve slide is not in the optimal compromise position, then the method 600 returns to step 620, where the tuning application continues determining the change in frequency of the last note as the valve slide is moved. On the other hand, if the tuning application determines at step 630 that the valve slide is in the optimal compromise position, then the method 600 continues to step 635, where the tuning application indicates to the musician to stop moving the valve slide or sends a control signal to the actuator to stop moving the valve slide, similar to step 530.

At step 640, the tuning application determines the frequencies of the same series of notes as the musician plays them again, similar to step 535. Then, at step 645, the tuning application determines whether the valve slide position needs further adjustment based on the series of notes played at step 640, similar to step 540. If the tuning application determines at step 645 that the valve slide position needs further adjustment, then the method 600 returns to step 605, where the tuning application determines the frequencies of the series of notes as those notes are played again by the musician in succession with the same valve of the instrument depressed. If, on the other hand, the tuning application determines at step 645 that the valve slide position does not need further adjustment, then the method 600 continues to step 650, where the tuning application determines whether all valve slides have been tuned.

If not all of the valve slides have been tuned, then at step 655 the tuning application indicates to the musician to switch to a next valve, and the method 600 then returns to step 605, where the tuning application determines, for another valve slide, whether notes playable with the valve slide can be played with previously tuned tuning or valve slides. If, however, all of the valve slides have been tuned, then the method 600 continues to step 660, where the tuning application determines the frequencies of a series of notes in a scale played by a musician on the brass instrument. The scale that is played should include notes that require the musician to depress all of the valves at some point or another (but not at the same time unless that happens to be a note in the scale) as well as open tuned notes. At step 665, the tuning application determines, based on the frequencies of the notes in the scale determined at step 660, whether another tuning iteration is necessary. If another tuning iteration is necessary, then the method 600 returns to step 505 of the method 500 and the tuning slides of the brass instrument are tuned again. If another iteration is not needed, the method 600 ends with the instrument in tune.

Figure 7:
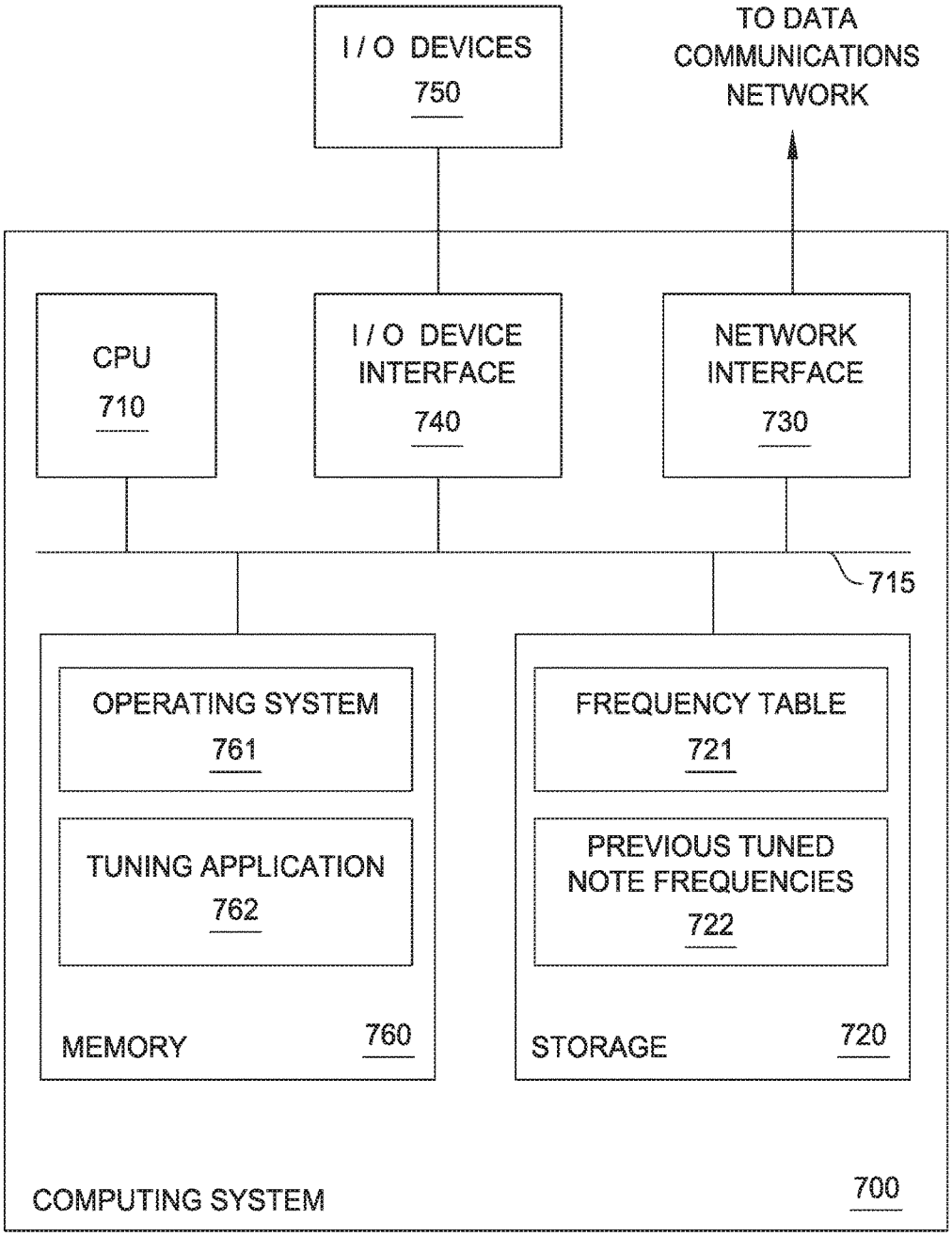
FIG. 7 illustrates a computer system in which an embodiment may be implemented.

FIG. 7 illustrates a computer system 700 in which an embodiment of this disclosure may be implemented. In one embodiment, the system 700 may be included in an automated tuning apparatus such as the tuning apparatus 300 discussed above with respect to FIG. 3 or the tuning apparatus 400 discussed above with respect to FIG. 4, in which case the system 700 may control an actuator such as the actuator 320 or 420 to automatically adjust a tuning (or valve) slide of a brass instrument to bring the instrument into tune. In another embodiment, the system 700 may be used to manually tune a brass instrument by, e.g., indicating to the musician actions to take (e.g., moving a tuning or valve side, or stopping) to bring the instrument into tune. As shown, the system 700 includes, without limitation, a central processing unit (CPU) 710, a network interface 730, an interconnect 715, a memory 760 and storage 720. The system 700 may also include an I/O device interface 740 connecting I/O devices 750 (e.g., keyboard, display and mouse devices) to the system 700.

The CPU 710 retrieves and executes programming instructions stored in the memory 760. Similarly, the CPU 710 stores and retrieves application data residing in the memory 760. The interconnect 715 facilitates transmission, such as of programming instructions and application data, between the CPU 710, I/O device interface 740, storage 720, network interface 730, and memory 760. The CPU 710 is representative of one or more of a single CPU, multiple CPUs, a single CPU having multiple processing cores, and the like. And the memory 760 is generally included to be representative of a random access memory. The storage 720 may be a flash drive or a disk drive storage device. Although shown as a single unit, the storage 720 may be a combination of fixed or removable storage devices, such as fixed disc drives, flash drives, removable memory cards or optical storage, network attached storage (NAS), or a storage area-network (SAN). The network interface 730 may include a wireless communication transceiver for transmitting and receiving tuned note frequencies to/from other tuning devices, if any. Further, the system 700 is included to be representative of a physical computing system, such as a mobile phone or tablet or a tuning apparatus, as well as virtual machine instances hosted on a set of underlying physical computing systems. Further still, although shown as a single computing system, one of ordinary skill in the art will recognized that the components of the system 700 shown in FIG. 7 may be distributed across multiple computing systems connected by a data communications network.

As shown, the memory 760 includes an operating system 761 and a tuning application 762. The tuning application 762 in particular is configured to automatically determine compromise tunings in musical instruments. In one embodiment, the tuning application 762 may tune tuning slides of a brass instrument by determining the frequencies of a series of notes that have open tunings on a horn of a brass instrument and that are played by a musician in succession with an "open" instrument; determining a distance that each note is away from a correct frequency in a frequency table 721 or from a previously tuned note frequency 722; determining the change in frequency of a last note in the series of notes as the musician holds the last note and a tuning slide is moved; determining the change in frequency of other notes in the series of notes based on the change in frequency of the last note and the initial frequencies of the other notes; determining whether the tuning slide is in an optimal compromise position; if the tuning slide is in the optimal compromise position, indicating to the musician to stop moving the tuning slide or, alternatively, sending a control signal to an actuator to stop moving the tuning slide; determining the frequencies of the same series of notes as the musician plays them again; and, if the tuning slide position does not need further adjustment, assisting in tuning other tuning slides or valve slides, according to the method 500 discussed above with respect to FIG. 5. In addition, the tuning application 762 may tune valve slides of a brass instrument by determining whether any notes that can be played with a currently used valve slide can also be played with previously tuned tuning slides or valve slides; determining the frequencies of those notes as the musician plays them using the already tuned tuning or valve slides; determining the frequencies of a series of notes on the brass instrument that are played by the musician in succession, with a valve of the instrument depressed; determining a distance that each note is away from a correct frequency in the frequency table 721 or from the frequency of the previously tuned note 722 determined for any notes that can be played with previously tuned tuning slides or valve slides; determining the change in frequency of a last note in the series of notes as the musician holds the last note and a valve slide is moved, either manually by the musician or automatically by an actuator; determining the change in frequencies of other notes in the series of notes based on the change in frequency of the last note and the initial frequencies of the other notes; determining whether the current valve slide is in an optimal compromise position that minimizes a total difference between the current and the desired frequencies of the notes in the note series; if the valve slide is in the optimal compromise position, indicating to the musician to stop moving the valve slide or sending a control signal to the actuator to stop moving the valve slide; determining the frequencies of the same series of notes as the musician plays them again; if the valve slide position does not need further adjustment, assist in tuning other valve slides, if any; determining, based on the frequencies of the notes played in a scale, whether another tuning iteration is necessary; and, if another tuning iteration is necessary, returning to tune the tuning slides of the brass instrument again, according to the method 600 discussed above with respect to FIG. 6.

Advantageously, techniques disclosed herein permit the tuning of musical instruments in which multiple notes share a common resonant path and all notes cannot be in tune simultaneously. This improves over traditional automated tuning devices that only allowed a note frequency to be exactly matched to a known correct frequency, which cannot effectively be used to tune musical instruments in which notes sharing a common resonant path cannot all be in tune at the same time. In one embodiment, a tuning application determines a compromise tuning so that the greatest number of notes is as close as possible to their correct frequencies in a frequency table and so that the instrument is in tune with itself. The tuning is performed on a range of notes rather than a single note at a time, and the compromising tuning is found automatically so that the musician does not need to change back and forth between notes continuously in a lengthy and tedious manual tuning process in which the optimal compromise is approximated through guesswork. In addition, the tuning application may indicate the determined compromise tuning to the musician who manually adjusts (e.g., the tuning or valve slides of) the instrument, or the tuning application may send a control signal to control one or multiple actuators that adjust the instrument to bring it into tune.

The descriptions of the various embodiments of the present invention have been presented for purposes of illustration, but are not intended to be exhaustive or limited to the embodiments disclosed. Many modifications and variations will be apparent to those of ordinary skill in the art without departing from the scope and spirit of the described embodiments. The terminology used herein was chosen to best explain the principles of the embodiments, the practical application or technical improvement over technologies found in the marketplace, or to enable others of ordinary skill in the art to understand the embodiments disclosed herein.

What is claimed is:

1. A method performed by a programmed computing device for tuning a musical instrument, the computing device including one more processors implemented using circuitry, a memory, either a linear actuator or an indicator for prompting a user to stop making tuning adjustments to the musical instrument, and at least one of a sensor and a wireless receiver for receiving sensor data, the method comprising:

determining initial frequencies of a plurality of notes played on the musical instrument by the user when the musical instrument is out of tune, wherein the plurality of notes include a first note and one or more other notes in a series that share a resonant path, and wherein tuning adjustments that change a frequency of any note in the plurality of notes affect frequencies of other notes in the plurality of notes;

determining a change in a frequency of the first note, as played on the musical instrument by the user, resulting from a first tuning adjustment made by the linear actuator or the user to the musical instrument;

determining, without the user playing the other notes on the musical instrument, a change in the frequency of each note of the other notes based, at least in part, on the change in the frequency of the first note, the initial frequency of the note, and a relationship between note frequencies;

determining a changed frequency of each note of the other notes based, at least in part, on the determined change in the frequency of the note and the initial frequency of the note;

determining, via the one or more processors, a compromise tuning adjustment of the musical instrument that minimizes a sum of differences between a changed frequency of each note of the first and the other notes and a predefined frequency of the note or a frequency to which the note was previously tuned;

monitoring the frequency of the first note as the linear actuator or the user makes additional tuning adjustments to the musical instrument to determine whether the frequency of the first note has changed by an amount indicating the compromise tuning adjustment that minimizes the sum of the differences is achieved; and responsive to determining during the monitoring that the compromise tuning adjust is achieved, either indicating to the user via the indicator to stop making the additional tuning adjustments to the musical instrument or automatically controlling the linear actuator to stop making the additional tuning adjustments to the musical instrument.

2. The method of claim 1, wherein:

the musical instrument is a brass instrument; and the compromise tuning adjustment is an adjustment of a tuning slide or valve slide of the brass instrument.

3. The method of claim 2, wherein:

the first note is a lowest note of the plurality of notes; and the change in the frequency of the first note is determined while the first note is being held and after the tuning slide or valve slide is moved by the user or the linear actuator.

4. The method of claim 3, further comprising:

determining frequencies that one or more of the plurality of notes were previously tuned to.

5. The method of claim 2, wherein:

a plurality of linear actuators in a plurality of devices including the computing device are each attached to a respective tuning slide and or valve slide of the brass instrument; and the plurality of devices are configured to communicate tuned note frequencies to each other via a wireless communication protocol.

6. The method of claim 2, wherein a plurality of horns of the brass instrument are tuned in succession, beginning with an open tuning of one of the plurality of horns.

7. The method of claim 1, further comprising:

determining the frequencies of the plurality of notes as the plurality of notes are re-played on the musical instrument; and either indicating to the user via the indicator or controlling the linear actuator to re-adjust tuning of the musical instrument if the determined frequencies of the plurality of notes as the plurality of notes are re-played differ from the predefined frequencies of the plurality of notes or the frequency to which the plurality of notes were previously tuned by more than a threshold value.

8. The method of claim 1, wherein:

determining the change in the frequency of the first note includes determining a change in a number of cents based, at least in part, on the initial frequency of the first note and the determined frequency of the first note after the first tuning adjustments is made to the musical instrument; and the changes in the frequencies of the other notes in the plurality of notes are determined based, at least in part, on the determined change in the number of cents and the initial frequencies of the other notes in the plurality of notes.

9. A non-transitory computer-readable storage medium storing a program, which, when executed by one or more processors in a computing device that includes the one more processors implemented using circuitry, a memory, either a linear actuator or an indicator for prompting a user to stop making tuning adjustments to a musical instrument, and at least one of a sensor and a wireless receiver for receiving sensor data, performs operations for tuning the musical instrument, the operations comprising:

determining initial frequencies of a plurality of notes played on the musical instrument by the user when the musical instrument is out of tune, wherein the plurality of notes include a first note and one or more other notes in a series that share a resonant path, and wherein tuning adjustments that change a frequency of any note in the plurality of notes affect frequencies of other notes in the plurality of notes;

determining a change in a frequency of the first note, as played on the musical instrument by the user, resulting from a first tuning adjustment made by the linear actuator or the user to the musical instrument;

determining, without the user playing the other notes on the musical instrument, a change in the frequency of each note of the other notes based, at least in part, on the change in the frequency of the first note, the initial frequency of the note, and a relationship between note frequencies;

determining a changed frequency of each note of the other notes based, at least in part, on the determined change in the frequency of the note and the initial frequency of the note;

determining a compromise tuning adjustment of the musical instrument that minimizes a sum of differences between a changed frequency of each note of the first and the other notes and a predefined frequency of the note or a frequency to which the note was previously tuned;

monitoring the frequency of the first note as the linear actuator or the user makes additional tuning adjustments to the musical instrument to determine whether the frequency of the first note has changed by an amount indicating the compromise tuning adjustment that minimizes the sum of the differences is achieved; and responsive to determining during the monitoring that the compromise tuning adjust is achieved, either indicating to the user via the indicator to stop making the additional tuning adjustments to the musical instrument or automatically controlling the linear actuator to stop making the additional tuning adjustments to the musical instrument.

10. The computer-readable storage medium of claim 9, wherein:

the musical instrument is a brass instrument; and the compromise tuning adjustment is an adjustment of a tuning slide or valve slide of the brass instrument.

11. The computer-readable storage medium of claim 10, wherein:

the first note is a lowest note of the plurality of notes; and the change in the frequency of the first note is determined while the first note is being held and after the tuning slide or valve slide is moved by the user or the linear actuator.

12. The computer-readable storage medium of claim 11, the operations further comprising, determining frequencies that one or more of the plurality of notes were previously tuned to.

13. The computer-readable storage medium of claim 10, wherein:

a plurality of linear actuators in a plurality of devices including the computing device are each attached to a respective tuning slide and or valve slide of the brass instrument; and the plurality of devices are configured to communicate tuned note frequencies to each other via a wireless communication protocol.

14. The computer-readable storage medium of claim 9, the operations further comprising:

determining the frequencies of the plurality of notes as the plurality of notes are re-played on the musical instrument; and either indicating to the user via the indicator or controlling the linear actuator to re-adjust tuning of the musical instrument if the determined frequencies of the plurality of notes as the plurality of notes are re-played differ from the predefined frequencies of the plurality of notes or the frequencies to which the plurality of notes were previously tuned by more than a threshold value.

15. The computer-readable storage medium of claim 9, wherein:

determining the change in the frequency of the first note includes determining a change in a number of cents based, at least in part, on the initial frequency of the first note and the determined frequency of the first note after the first tuning adjustments is made to the musical instrument; and the changes in the frequencies of the other notes in the plurality of notes are determined based, at least in part, on the determined change in the number of cents and the initial frequencies of the other notes in the plurality of notes.

16. A system, comprising:

one or more processors implemented using circuitry;

either a linear actuator or an indicator for prompting a user to stop making tuning adjustments to a musical instrument;

at least one of a sensor and a wireless receiver for receiving sensor data; and a memory, wherein the memory includes an application program which, when executed by the one or more processors, performs operations for tuning the musical instrument, the operations comprising:

determining initial frequencies of a plurality of notes played on the musical instrument by the user when the musical instrument is out of tune, wherein the plurality of notes include a first note and one or more other notes in a series that share a resonant path, and wherein tuning adjustments that change a frequency of any note in the plurality of notes affect frequencies of other notes in the plurality of notes, determining a change in a frequency of the first note, as played on the musical instrument by the user, resulting from a first tuning adjustment made by the linear actuator or the user to the musical instrument, determining, without the user playing the other notes on the musical instrument, a change in the frequency of each note of the other notes based, at least in part, on the change in the frequency of the first note, the initial frequency of the note, and a relationship between note frequencies, determining a changed frequency of each note of the other notes based, at least in part, on the determined change in the frequency of the note and the initial frequency of the note, determining a compromise tuning adjustment of the musical instrument that minimizes a sum of differences between a changed frequency of each note of the first and the other notes and a predefined frequency of the note or a frequency to which the note was previously tuned, monitoring the frequency of the first note as the linear actuator or the user makes additional tuning adjustments to the musical instrument to determine whether the frequency of the first note has changed by an amount indicating the compromise tuning adjustment that minimizes the sum of the differences is achieved, and responsive to determining during the monitoring that the compromise tuning adjust is achieved, either indicating to the user via the indicator to stop making the additional tuning adjustments to the musical instrument or automatically controlling the linear actuator to stop making the additional tuning adjustments to the musical instrument.

17. The system of claim 16, wherein automatically controlling the linear actuator to stop making the additional tuning adjustments includes sending one or more control signals to the linear actuators.

18. The system of claim 16, wherein the wireless communication receiver is a wireless communication transceiver, and wherein the operations further comprise:

transmitting tuned note frequencies of the musical instrument to one or more other devices; and receiving tuned note frequencies of the musical instrument from the one or more other devices.

* * * * *